United States Patent [19]

Kahrilas et al.

[11] Patent Number: 4,965,602

[45] Date of Patent: Oct. 23, 1990

[54] DIGITAL BEAMFORMING FOR MULTIPLE INDEPENDENT TRANSMIT BEAMS

[75] Inventors: Peter J. Kahrilas, Placentia; Thomas W. Miller, Yorba Linda, both of Calif.; Samuel P. Lazzara, Genese, Belgium

[73] Assignee: Hughes Aircraft Company, Los Angeles, Calif.

[21] Appl. No.: 422,934

[22] Filed: Oct. 17, 1989

[51] Int. Cl.[5] ..... H01Q 3/22; H01Q 3/24; H01Q 3/26

[52] U.S. Cl. ..... 342/372

[58] Field of Search ..... 342/375, 372

[56] References Cited

U.S. PATENT DOCUMENTS 4,277,787 7/1981 King .

OTHER PUBLICATIONS

"Digital Multiple Beamforming Techniques for Radar," Abraham E. Ruvin, Leonard Weinbeg, IEEE EASCON '78 Record, pp. 162–163, Sep. 25–27, 1978, IEEE Publication 78 CH 1354–CH 1354–1355 AES.

*Primary Examiner*—Theodore M. Blum

*Attorney, Agent, or Firm*—Wanda K. Denson-Low

[57] ABSTRACT

A phased array antenna system is disclosed which employs digital beamforming of multiple independent transmit beams. A waveform generator provides successive digitized time samples of a desired waveform, and the respective beamforming coefficients which produce the desired amplitude and phase distribution for each beam are applied to the waveform samples. The resulting digital samples are then mixed up to IF, converted to digital form, frequency converted to the desired RF frequency, amplified and passed to the respective antenna subarrays. The transmit system permits fine granularity phase control, providing accurate beamforming and positioning and improved sidelobe control.

12 Claims, 2 Drawing Sheets

DIGITAL BEAMFORMING FOR MULTIPLE INDEPENDENT TRANSMIT BEAMS

BACKGROUND OF THE INVENTION

The present invention relates to the field of phased array systems, and more particularly to a technique for digital formation of multiple independent beams on transmission.

It is well known that phased antenna arrays can be configured to provide the capability of transmitting multiple independent beams. See, e.g., "Introduction to Radar Systems," Merrill I. Skolnick, McGraw-Hill Book Company, second edition, 1980, pages 310–318. The typical techniques for producing multiple independent transmit beams include complex feed networks with multiple phase shifters (one set for each beam), complex lenses or complex hybrid phasing matrices. These techniques can all be shown to have relative weight, size, performance and cost disadvantages, particularly for space and airborne radar application.

Techniques have been described in the literature for generating multiple beams on receive by digital beamforming techniques. "Digital Multiple Beamforming Techniques for Radar," Abraham E. Ruvin and Leonard Weinberg, IEEE EASCON '78 Record, pages 152–163, Sept. 25–27, 1978, IEEE Publication 78 CH 1354-4 AES. No description appears in this reference of forming independent multiple transmit beams by digital beamforming techniques.

It is therefore an object of the present invention to provide a phased antenna array system having the capability of generating multiple independent beams without the use of multiple sets of phase shifters, complex lenses or hybrid phasing matrices.

A further object of the present invention is to provide a phased antenna array system having the capability of generating multiple independent transmit beams by digital beamforming techniques.

SUMMARY OF THE INVENTION

A method and apparatus for digital beamforming of multiple independent transmit beams from a phased array system is disclosed. A system in accordance with the invention includes an antenna aperture divided into a plurality of subarrays. A digital waveform generator is included for generating in-phase (I) and quadrature (Q) sequential digital samples of a desired signal waveform to be transmitted.

The system further includes a means for providing, for each transmit beam to be formed, a different set of beamsteering phasors in digital form, the set of phasors representing the amplitude and phase distribution for the particular desired beam position and sidelobe distribution. The system also includes means for applying the respective sets of beamsteering coefficients to the respective in-phase and quadrature signal components to provide resulting I and Q coefficients.

The system includes means for upconverting the I and Q coefficients to an intermediate (IF) frequency, converting the digital IF I and Q coefficients into analog form, means for upconverting the analog signals to the desired RF transmit frequency, amplifying the RF signals, and then feeding the corresponding amplified RF signals to the appropriate antenna subarray for transmission out of the array.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
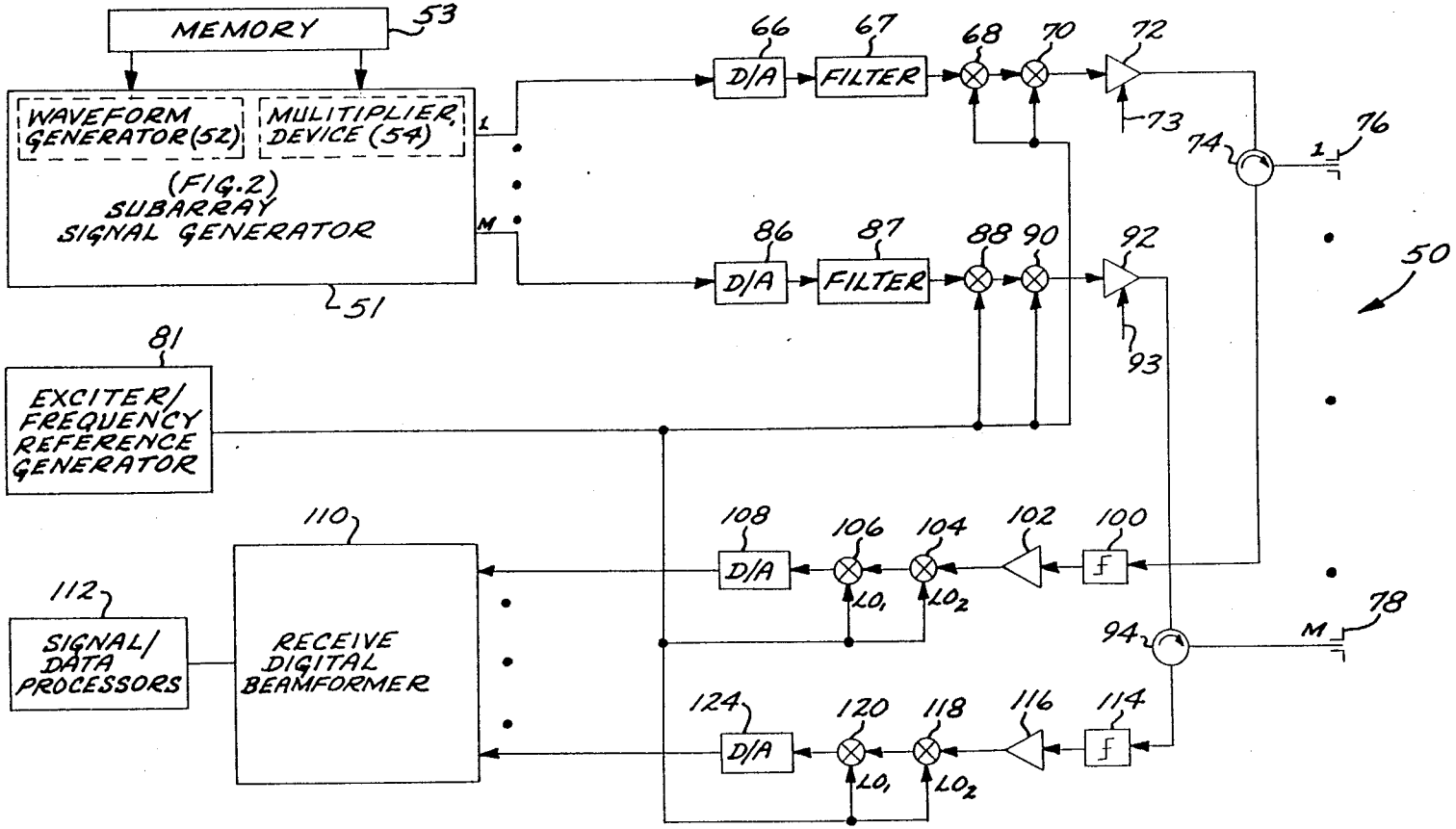
FIG. 1 is a simplified schematic block diagram of a phased array antenna system employing the present invention to produce multiple independent transmit beams by digital beamforming techniques.

A phased array antenna system 50 employing the invention is shown in FIG. 1. The system 50 comprises a subarray signal generator 51, which in turn includes a waveform generator 52 which generates a video signal representing a desired waveform to be transmitted. The waveform is synthesized digitally, and in-phase (I) and quadrature (Q) samples of the waveform are fed to the multiplier device 54 comprising the subarray signal generator 51.

The synthesis of the waveform can be done by generator 52 in one of several ways. For example, if the waveform is repetitive, as in a radar application, samples (time series) of the radar pulse could be stored in read-only-memory (ROM) 53. To synthesize both phase and amplitude, in-phase and quadrature components of the baseband signal waveform are generated.

The I and Q samples from the waveform modulator of the waveform generator 52, which are represented as $\alpha(t_i)e^{k\phi(t_i)}$, are the baseband representation of the radar transmitted waveform. By representing each sample by the complex number $I+jQ$, the center frequency can be shifted from baseband to a different center frequency $f_o$ by $$S(k)=[\alpha t_k)e^{j\phi(t_k)}]e^{jw_o t_k} \quad (1)$$

where $t_k$ = time at the kth sample instant $w_o = 2\pi f_o$

Figure 2:
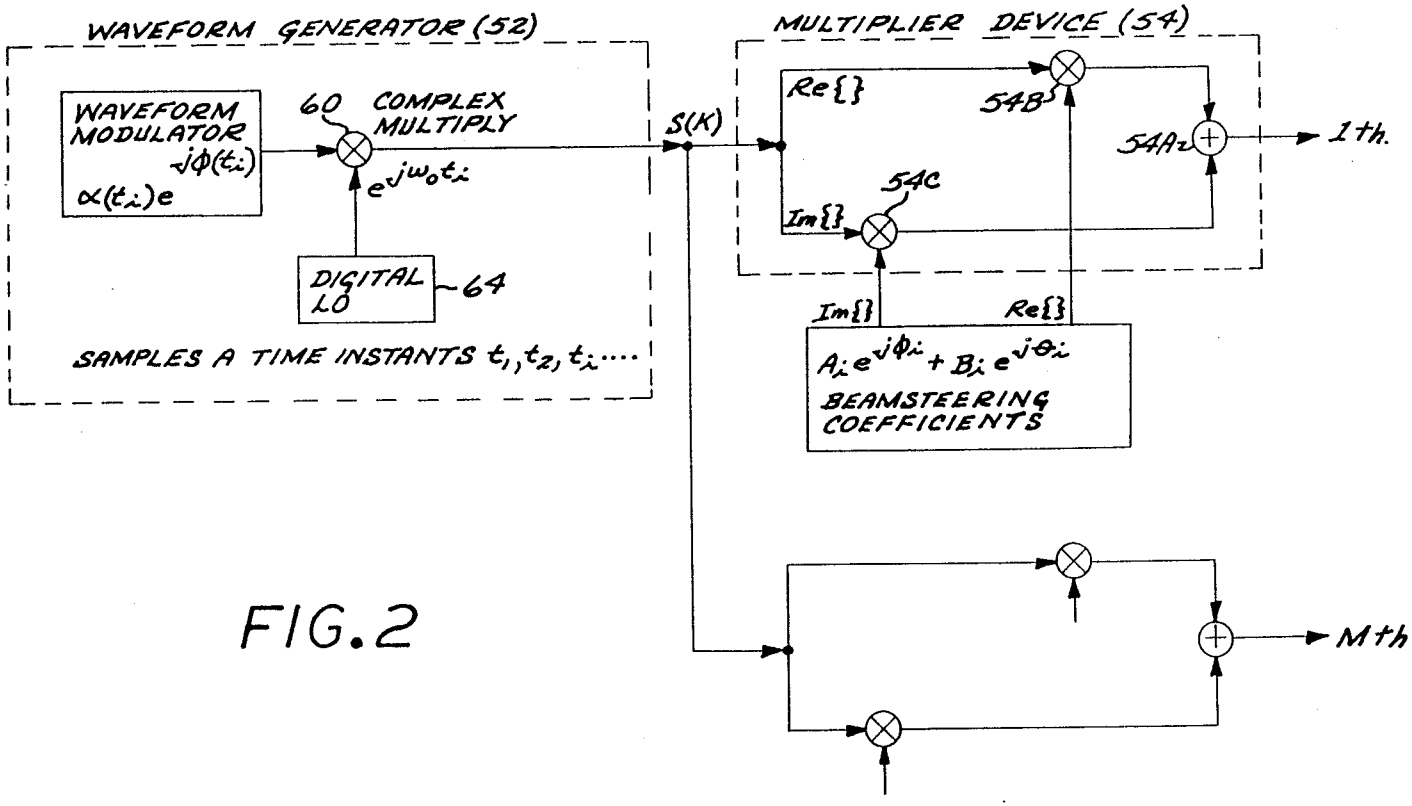
FIG. 2 is a block diagram illustrative of one technique for applying the beamsteering coefficients to the waveform time samples.

The mathematical operation described in equation (1) is performed in the waveform generator 52 by the complex number multiplier (60) and digital local oscillator (LO) 64 shown in FIG. 2. By performing this mixing operation, the waveform is converted from its baseband I and Q representation to its complex number Intermediate Frequency representation.

In FIG. 1, the antenna aperture is divided into M subarrays. Each subarray may consist of single or multiple antenna elements. In the latter case, the subarray radiation pattern may be steered using conventional microwave (analog) beamforming techniques. In addition, amplitude taper within the subarray aperture may be employed to reduce the sidelobes of the subarray radiation pattern. Reduction of sidelobes together with physical overlap of the subarrays can be used to mitigate the effects of grating lobes that can occur when forming multiple beams from a subarrayed antenna.

The transmit beamforming coefficients may also be stored in the memory 53, and are applied to the signal samples from the waveform generator 52 of the subarray signal generator shown in FIG. 2 by the multiplier device 54 to produce the transmit antenna beams. The amplitude and phase distribution for each beam is determined by the desired beam position (angle) and sidelobe distribution. Mathematically, to generate a single beam, the device 54 multiplies each time sample from the waveform generator 52 by a phasor $A_i\exp(j\phi_i)$ as follows:

$$y_i(k) = Re[S(k)A_i e^{j\phi_i}] \quad (2)$$
$$= Re[S(k)]Re[A_i e^{j\phi_i}] - Im[S(k)]Im[A_i e^{j\phi_i}]$$

where S(k)=synthesized waveform (I+jQ) at the kth time sample, $A_i$=amplitude taper at the ith subarray, $\phi_i$=phase shift at the ith subarray, and $y_i(k)$ =input sample to the ith subarray at the kth time instant.

In order to generate multiple beams, the algebraic summation of the respective phasors for each beam is formed, and the time samples from the waveform generator 52 are multiplied by the algebraic sum. Here, two beams are to be formed, with the amplitude and phase distribution of the first beam defined by the phasor $A_i\exp(j\phi_i)$ and the amplitude and phase distribution of the second beam defined by the phasor $B_i\exp(j\phi_i)$. In this case, the input sample to the ith subarray at the kth time instant is determined as shown in eq. 3.

$$y_i(k) = Re[S(k)(A_i e^{j\phi_i} + B_i e^{j\theta_i})] \quad (3)$$
$$= Re[S(k)C_i]$$
$$= Re[S(k)]Re[C_i] - I_m[(S(k)]I_m[C_i]$$

where $$C_1 = A_i e^{j\phi_i} + B_i e^{j\theta_i} \quad (4)$$

and $B_i$=amplitude taper of the second beam at the ith subarray, $\theta_i$=phase shift of the second beam at the ith subarray. Obviously the number of beams formed in this manner can be extended to any number.

As illustrated in FIG. 2, the multiplier device 54 for the exemplary ith subarray channel multiplies the real and imaginary components of the complex waveform $y_i(k)$ by the respective real and imaginary components of the algebraic sum (represented as $C_i$) as described in equation 3. The products from multipliers 54B and 54C are then summed at summer 54A to form the resulting signal waveform $y_i(k)$ After the I and Q samples of the multiplier output are summed by summer 54A, the sum signal is converted to analog form by digital-to-analog converter (DAC) 66. The resulting analog signal is mixed up to the RF transmit frequency by mixers 68 and 70 and local oscillator signals LO1 and LO2 generated by reference signal generator 81. The RF signal is amplified by the transmit power amplifier 72, and transmitted out of the subarray via circulator 74 and the subarray radiating element(s) 76.

Two upconverting local oscillators are employed to reduce the required speed of operation of the DAC 66. For example, the LO1 frequency may typically be in the range of 10–30 MHz, and the LO2 frequency may typically be at L band (1–3 GHz). The use of the LO1 signal is not mandatory but simplifies the filtering of unwanted image sidebands created during the mixing process by filters 67 and 87.

In a similar fashion, the I and Q coefficients for the Mth subarray are multiplied with the LO 64 signal by multipliers 80 and 82 to mix from baseband to the low IF frequency. The digital samples are then converted to analog form by DAC 86, mixed up the transmit RF frequency by mixers 88 and 90 and LO1 and LO2, amplified by amplifier 92, and then transmitted out of the Mth subarray via the circulator 94 and the radiating element(s) 78.

The system 50 of FIG. 1 employs "IF" sampling techniques to allow conversion with a single DAC for each subarray. Moreover, the phase and amplitude distribution for each beam could alternatively be generated by imposing the appropriate amplitude and phase on the digital LO 64, rather than on the signal samples themselves by the multiplier device 54; in some applications, this approach would reduce computation requirements.

The system 50 further comprises receive elements for each subarray. For clarity only the elements for the first and Mth subarray are shown in FIG. 1. Thus, the first subarray radiating element(s) 76 is coupled through circulator 74 to protector circuit 100, and the signal is amplified by low noise amplifier 102. The protector circuit 100 prevents a large signal from damaging the low noise amplifier 102; a typical protector circuit is a diode limiter protector. The amplified receive signal is downconverted by mixing with LO1 and LO2 at mixer devices 104 and 106, converted to digital form by analog to digital converter (ADC) 108, and the digitized signal is fed to the receive digital beamformer 110 to form the desired receive beams. The data for each beam is then fed to the signal and data processors 112.

In a similar fashion the signals received at the Mth subarray are fed through a protector device 114 and amplified by amplifier 116, downconverted by mixing with LO1 and LO2 at mixers 118 and 120, and converted to digital form at ADC 124. The digital signals are processed by the receive digital beamformer 110 and the processor 112.

It is contemplated that fiber optic signal transmission technology can be advantageously employed to transmit signals, on the transmit side, between the multiplier device 54 and the respective transmit power amplifiers 72 and 92, and on the receive side, between the low noise amplifiers 102 and 116 and the receive digital beamformer 110. An exemplary fiber optic feed network is described in U.S. Pat. No. 4,814,773.

A digital transmit beamformer for phased array systems has been disclosed which provides several advantages. For example, with digital beamforming the phase angles are digitally controlled, and enough digital bits can be used to establish each phase angle very precisely. In contrast, analog phase shifters have a relatively small number of discrete phase settings, and are subject to further phase errors due to manufacturing and temperature tolerances. The resulting phase errors degrade the beam and lead to increased sidelobe levels. Therefore, digital beam formation in accordance with the invention results in very significant reductions in phase errors. As a result, the invention provides more accurate beamforming and positioning with improved sidelobe control. Precise control of the phase angle also permits ready formation of custom beams (as in conformal arrays). Additional advantages include the fact that digital transmit beamforming is non-dispersive, unlike conventional microwave techniques, and is applicable at all RF frequencies. In fact the invention is particularly well suited to very high RF frequencies (e.g., millimeter wave frequencies at 60–70 GHz) for which analog phase shifters are difficult to construct. A further advantage is that digital transmit beamforming in accordance with the invention is applicable for synthesizing time-delays for broadband beam forming, in which the time of successive radiators is delayed to obtain both phase and time coherency in the radiated wavefront at an angle from broadside.

It is understood that the above-described embodiments are merely illustrative of the possible specific embodiments which may represent principles of the present invention. Other arrangements may readily be devised in accordance with these principles by those skilled in the art without departing from the scope of the invention. For example, it will be apparent that different frequencies may be used for the different beams. One technique for achieving this result is to use different local oscillator frequencies on transmit at the respective local oscillators 64. Of course, correspondingly different local oscillator frequencies will be used on receive.

What is claimed is:

1. In a phased array system having an antenna aperture divided into a plurality of subarrays, a method of digital beamforming of multiple independent transmit beams, comprising a sequence of the following steps:

(i) generating in-phase (I) and quadrature (Q) sequential digital samples of a desired signal wave-form to be transmitted;

(ii) for each transmit beam to be formed, providing a different set of beamsteering phasors in digital form, each phasor representing the amplitude and phase distribution for the desired beam position and sidelobe distribution;

(iii) applying the respective sets of beamsteering phasors in digital form to said in-phase and quadrature signal components to provide resulting I and Q coefficients in digital form for each subarray;

(iv) upconverting the digital I and Q coefficients for each subarraay to an intermediate frequency (IF);

(v) converting the IF digital I and Q coefficients for each subarray into analog form;

(vi) upconverting the analog IF I and Q coefficients for each subarray to the desired RF transmit frequency;

(vii) amplifying the RF signals for each subarray; and (viii) feeding the corresponding RF signals to the appropriate subarrays for transmission out of the array.

2. The method of claim 1 wherein said step of applying said beamsteering phasors comprises forming the algebraic sum in digital form of said phasors, and multiplying the sequential digital samples of the signal waveform by the algebraic sum in digital form.

3. The method of claim 1 wherein the step of generating said digital samples of a desired signal waveform comprises reading predetermined digital signals from a digital memory.

4. The method of claim 1 wherein said step of upconverting the I and Q coefficients to an IF frequency comprises multiplying the I and Q coefficients by a digital local oscillator signal.

5. The method of claim 1 wherein said step of converting the IF I and Q coefficients to analog form comprises summing the IF I and Q coefficients to provide a sum signal in digital form and converting the sum signal to analog form by a digital-to-analog converter.

6. The method of claim 5 wherein said step of upconverting the analog sum signal to the desired RF frequency comprises mixing the sum signal with a first local oscillator signal to upconvert the sum signal to a first RF frequency, and mixing the upconverted signal at the first RF frequency with a second local oscillator signal to upconvert to the desired RF frequency.

7. A phases array system employing digital beamforming of multiple independent transmit beams, comprising:

an antenna aperture divided into a plurality of subarrays;

means for generating in-phase (I) and quadrature (Q) sequential digital samples of a desired signal waveform to be transmitted;

means for providing, for each transmit beam to be formed, a different set of beamsteering phasors in digital form, each phasor representing the amplitude and phase distribution for the particular desired beam position and sidelobe distribution;

means for applying the respective sets of beamsteering phasors in digital form to said in-phase and quadrature signal components to provide resulting I and Q coefficients in digital form for each subarray;

means for upconverting the digital I and Q coefficients for each subarray to an intermediate frequency (IF);

means for converting the digital IF I and Q coefficients for each subarray into analog form;

means for upconverting the analog IF I and Q coefficients for each subarray to the desired RF transmit frequency;

means for amplifying the RF signals for each subarray; and means for feeding the corresponding RF signals to the appropriate subarrays for transmission out of the array.

8. The phased array system of claim 7 wherein said means for applying said beamsteering phasors comprises means for forming the algebraic sum in digital form of said phasors, and means for multiplying the sequential digital samples of the signal waveform by the algebraic sum in digital form.

9. The phased array system of claim 7 wherein said means for generating said digital samples of a desired signal waveform comprises means for reading predetermined digital samples from a digital memory.

10. The phased array system of claim 7 wherein said means for upconverting the I and Q coefficients to an IF frequency comprises a digital local oscillator for generating a digital local oscillator signal, and means for multiplying the respective I and Q coefficients by said digital local oscillator signal.

11. The phased array system of claim 7 wherein said means for converting the IF I and Q coefficients to analog form comprises means for summing the IF I and Q coefficients to provide a sum signal in digital form and an digital-to-analog converter for converting the digital sum signal to analog form.

12. The phased array system of claim 11 wherein said means for upconverting the analog sum signal to the desired RF frequency comprises means for mixing the analog sum signal with a first local oscillator signal to upconvert the analog sum signal to a first RF frequency, and means for mixing the upconverted signal at the first RF frequency with a second local oscillator signal to upconvert to the desired RF frequency.

* * * * *